US005706708A

United States Patent [19]

Refalo et al.

[11] Patent Number: 5,706,708

[45] Date of Patent: Jan. 13, 1998

[54] AUTOMATIC SCEW GUN

[76] Inventors: Anthony Refalo; Martin Sammut, both of 22-68 27th St., Astoria, N.Y. 11105

[21] Appl. No.: 664,697

[22] Filed: Jun. 17, 1996

[51] Int. Cl.[6] ..... B25B 23/03

[52] U.S. Cl. ..... 81/57.37; 81/434

[58] Field of Search ..... 81/57.14, 57.3, 81/57.37, 433–435; 173/13, 18

[56] References Cited

U.S. PATENT DOCUMENTS 2,266,302 12/1941 Blair .
3,891,014 6/1975 Gunn .
5,584,221 12/1996 Petrantoni ..... 81/434

*Primary Examiner*—James G. Smith
*Attorney, Agent, or Firm*—Michael I. Kroll

[57] ABSTRACT

A powered screw gun having a magazine for storage of screws. The housing of the gun is arranged to provide a broad, flat base which rests on the work piece receiving screws, and two arms or towers projecting perpendicularly from the flat base. A handle is slidably mounted on the two arms. When the handle is depressed, or moved towards the flat base, a screw driver blade moves in tandem therewith. A return spring returns the handle to the original position. A pneumatic shock absorber prevents excessively abrupt return of the handle. A motor located in a fixed location remote from the blade rotates the blade by a drive train which accommodates projection of the blade towards and away from the work piece. The bit of the blade is removable, and held in place magnetically. The switch for reversibly operating the motor is carried on the movable handle. Indicia indicates the position of the blade and a screw being driven, which screw is concealed within the housing.

12 Claims, 3 Drawing Sheets

AUTOMATIC SCEW GUN

BACKGROUND OF THE INVENTION

1. Field of the Invention

The instant invention relates generally to hand held power tools and more specifically it relates to an automatic screw gun having a rotated screw driving blade. The gun has a housing held flush against a supporting surface. The blade is manually depressed into engagement with a screw to be driven. When released from the user's grasp, a spring returns the blade into a retracted position.

2. Description of the Prior Art

Numerous hand held power tools that are adapted to drive screws and nails into work piece save been provided in the prior art. An example is seen in U.S. Pat. No. 2,266,302, issued to Walter Blair on Dec. 16, 1941. Blair's drive blades project forwardly to engage a screw responsive to a manual control located at the grip of the tool. Unlike Blair, the entire grip of the present invention moves with respect to the housing to cause the blade to project towards the driven fastener. And unlike Blair, the present invention has a stop for limiting projection of the drive blade.

U.S. Pat. No. 3,891,014, issued to David T. Gunn on Jun. 24, 1975, describes a magazine for successively feeding screws to a powered screwdriver. There is no teaching of the screwdriver having a housing and a grip relatively movable with respect to the housing. Nor is there a teaching of a stop built into the screwdriver for limiting projection of the drive blade.

Neither of the above inventions and patents, taken either singly or in combination, is seen to describe the instant invention as claimed.

SUMMARY OF THE INVENTION

The present invention provides a powered screw driving tool which enables the user to vary projection of the drive blade with a considerable degree of manual control. The tool rests on the work surface receiving the driven fastener, which provides a stable supporting surface for the tool. The bulk of the mass of the tool rests stably upon the work surface, while the grip of the tool rides in a track defined in the housing of the tool. A stop prevents excessive projection of the drive blade from the tool.

The housing of the novel tool has a flat base for resting against a wall. The drive blade is gear driven from a motor enclosed by the housing. The blade is grooved along its entire length, so that when the blade is moved, it remains in geared relation to the motor.

Projection of the drive blade is controlled by the manual grip. When the grip is depressed towards the work surface, the blade moves in tandem. A spring urges the grip towards a retracted position. Spring tension is light, so that minimal effort is required to depress the grip and thus cause the drive blade to project. A pneumatic damper is connected to the spring, for preventing instantaneous rebound of the grip if released in the fully depressed position. The stop is built into the spring and damper housing.

Screws are fed into alignment with the drive blade by a magazine. The screws are arranged in a row, and are connected by taping or lacquering the heads of the screws. The head of the forwardmost screw is located directly under the tip of the driver shaft and the threaded shank is above an exit port. A person can grasp the handle manually a hand, place the housing against a work piece, depress the handle to allow the tip of the driver shaft to engage a screw, and operate the motor. The handle may then be depressed to force the screw from the exit port and to thread into the work piece.

The motor is operated by a switch, and is reversible for enabling both installation and removal of screws.

It is an object of the present invention to provide an automatic screw gun that drives, one at a time, a series of especially fabricated screws which are attached together at their heads in a row, while stored within the gun, into a work surface.

Another object is to provide a screw gun which rests against the work surface and enables manual projection of the driver blade towards the work surface.

An additional object is to provide an automatic screw gun that contains a reversible motor, so as to allow the removal of the screws from the work surface when the need arises.

A further object is to provide an automatic screw gun that is easy to use.

It is an object of the invention to provide improved elements and arrangements thereof in an apparatus for the purposes described which is inexpensive, dependable and fully effective in accomplishing its intended purposes.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
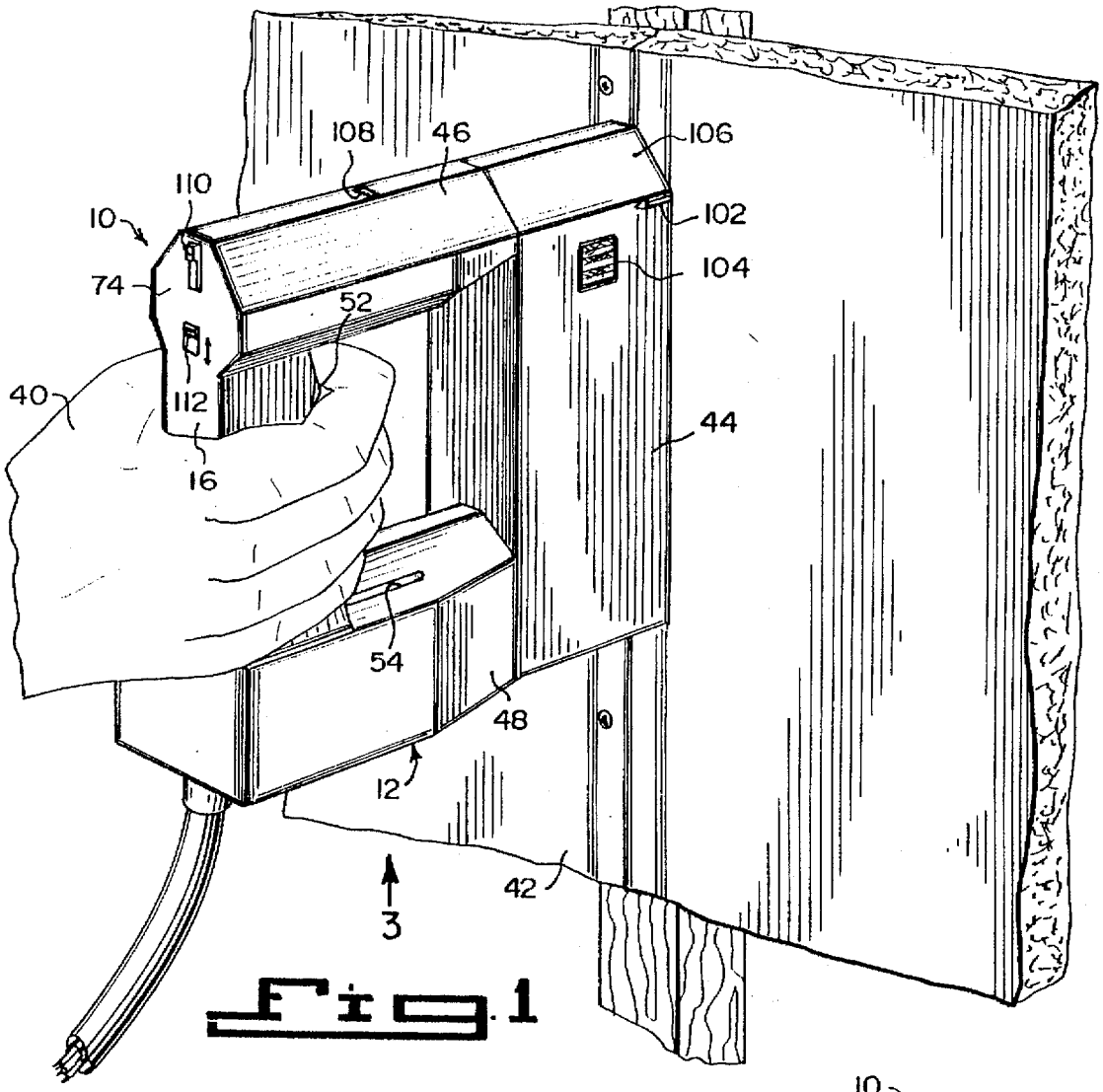
FIG. 1 is a perspective view of the instant invention in use, with the handle in an original position.
Figure 3:
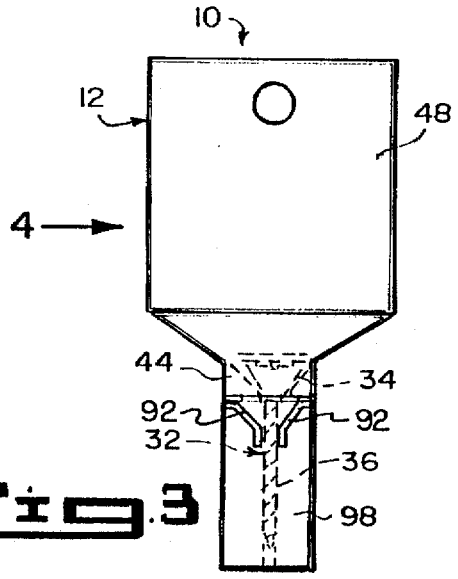
FIG. 3 is a bottom plan view of the invention, this being the view indicated by arrow 3 in FIG. 1.
Figure 4:
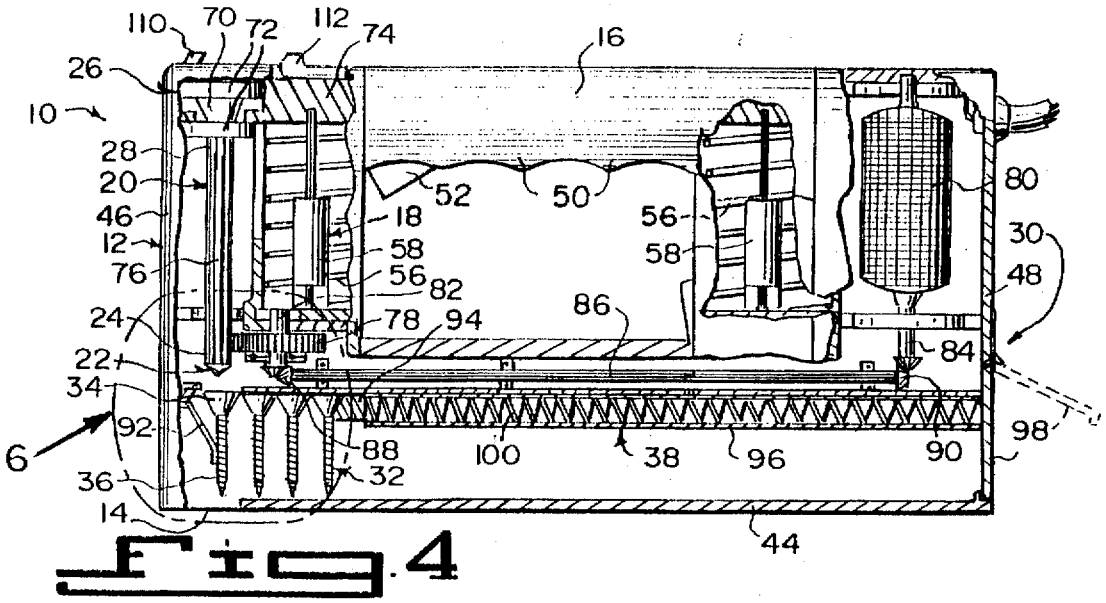
FIG. 4 is a side view taken in the direction of arrow 4 in FIG. 3, partially broken away to reveal internal detail, and partially in cross section.

Turning now to the drawings, in which similar reference characters denote similar elements throughout the several views, FIGS. 1, 3, 4 and 6 illustrate an automatic screw gun 10 comprising a housing 12 having an exit port 14, best seen at the lower left of FIG. 4, and a handle 16. Handle 16 is constrained by a guide assembly 18 to move in a short path along housing 12 when depressed for operation, as will be described further hereinafter. FIG. 1 illustrates the invention with the handle 16 in the normal position. FIG. 7 shows the handle fully depressed.

Enclosed within housing 12, and as best seen in FIG. 4, a driver shaft 20 has a tip 22 on a lower end 24. The driver shaft 20 is suitably journaled within the housing 12.

A coupling structure 26 carries an upper end 28 of the driver shaft 20 in a rotatable manner and at a right angle to the handle 16, so that the driver shaft 20 will move in tandem with the handle 16 towards the exit port 14 when the handle 16 is depressed. Coupling structure 26 includes a thrust bearing (not separately shown) to enable driver shaft to rotate while being depressed simultaneously with handle 16.

Driver shaft 20 is connected to a motor 80 by a drive train 30 contained within housing 12. Drive train 30 will be further described hereinafter.

Figure 2:
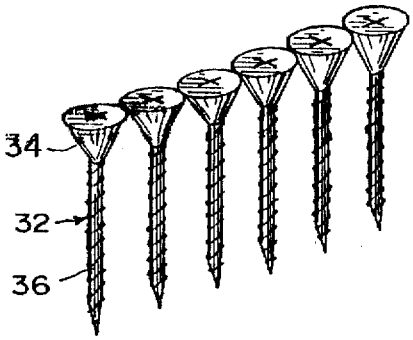
FIG. 2 is a perspective view of screws which are used in conjunction with the instant invention.

A plurality of screws 32, shown illustratively isolated from screw gun 10 in FIG. 2, are each provided with a head 34 and threaded shank 36. The heads 34 are attached to each other in a row by a bead or stratum of lacquer, adhesive or frangible tape (none of these shown) applied to the top of the heads 34. A magazine 38 holds the screws 32 within the housing 12 parallel to and spaced away from the handle 16.

The head 34 of the forward screw 32 is directly under the tip 22 of the driver shaft 20 and the threaded shank 36 is above the exit port 14. Driver shaft 20 is directed towards exit port 14, so that screws are dispensed through port 14. When the user operates screw gun 10, the tip 22 of the driver shaft 20 engages the head 34 of the forwardmost screw 32, that is, the screw positioned directly below driver shaft 20. Depression of handle 16 and of driver shaft 20 will then engage and rotate the forwardmost screw 32. This screw 32 is then dispensed through exit port 14 and threads into the work piece 42.

The housing 12 is in a generally U-shaped configuration having a flat, hollow base 44 and two extending, spaced apart hollow arms 46 and 48. The exit port 14 is located at one end of the hollow base 44 under the first hollow arm 46. The handle 16 includes a plurality of finger grips 50 and a trigger 52 operating a switch to energize the motor 80.

The guide assembly 18 comprises a pair of open passageways defined within the walls of housing 12. Each passageway encloses one of two ends 74 of handle 16, so that handle 16 is constrained to travel towards and away from base 44 in a path limited by the extent of these passageways.

A return mechanism biasing handle 16 to return to the retracted position illustrated in FIGS. 1 and 4 comprises two substantially identical return assemblies also housed within arms 46 and 48. Each return assembly includes a compression spring 56 which acts on one end 74 of handle 16.

Figure 5:
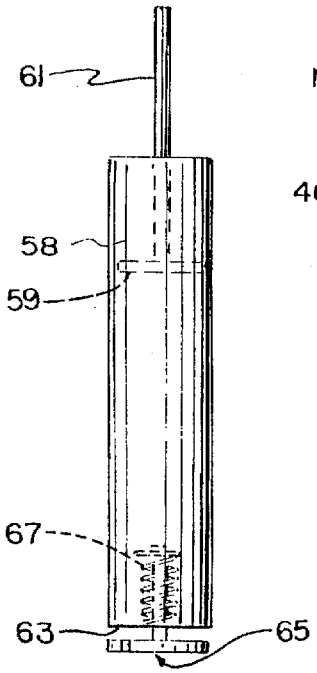
FIG. 5 is an enlarged elevational detail view of a shock absorber shown at the left of FIG. 4.

Each return assembly also incorporates a shock absorber 58 for damping excessively abrupt return of handle 16 to its original position, as might occur if handle 16 were suddenly released. Shock absorber 58 comprises a plunger 59 contained within a cylindrical housing, as best seen in FIG. 5. The plunger 59 is driven by a stem 61 anchored at an end 74 of handle 16.

The floor 63 of this cylinder supports a relief valve 65 enabling air to escape when compressed by the plunger 59. A spring 67 incorporated into the valve 65 also slows rapid descent of the plunger 59 and hence also slows descent of handle 16. Resistive force exerted by the spring 67 is sensed by the user, and serves notice that handle 16 is approaching the lower limit of its permissible travel.

Figure 6:
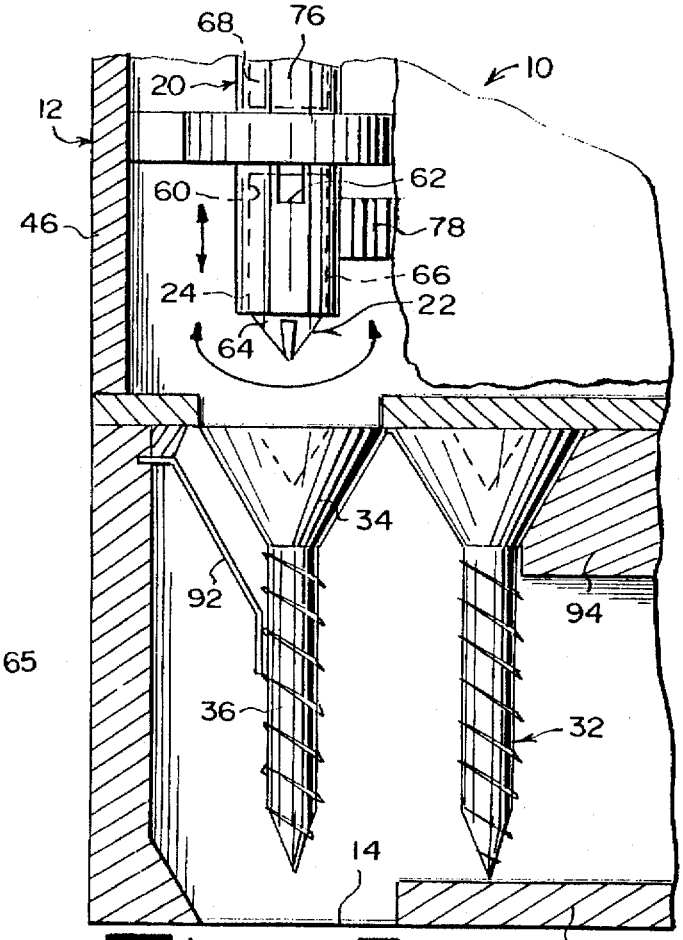
FIG. 6 is an enlarged view as indicated by arrow 6 in FIG. 4.
Figure 7:
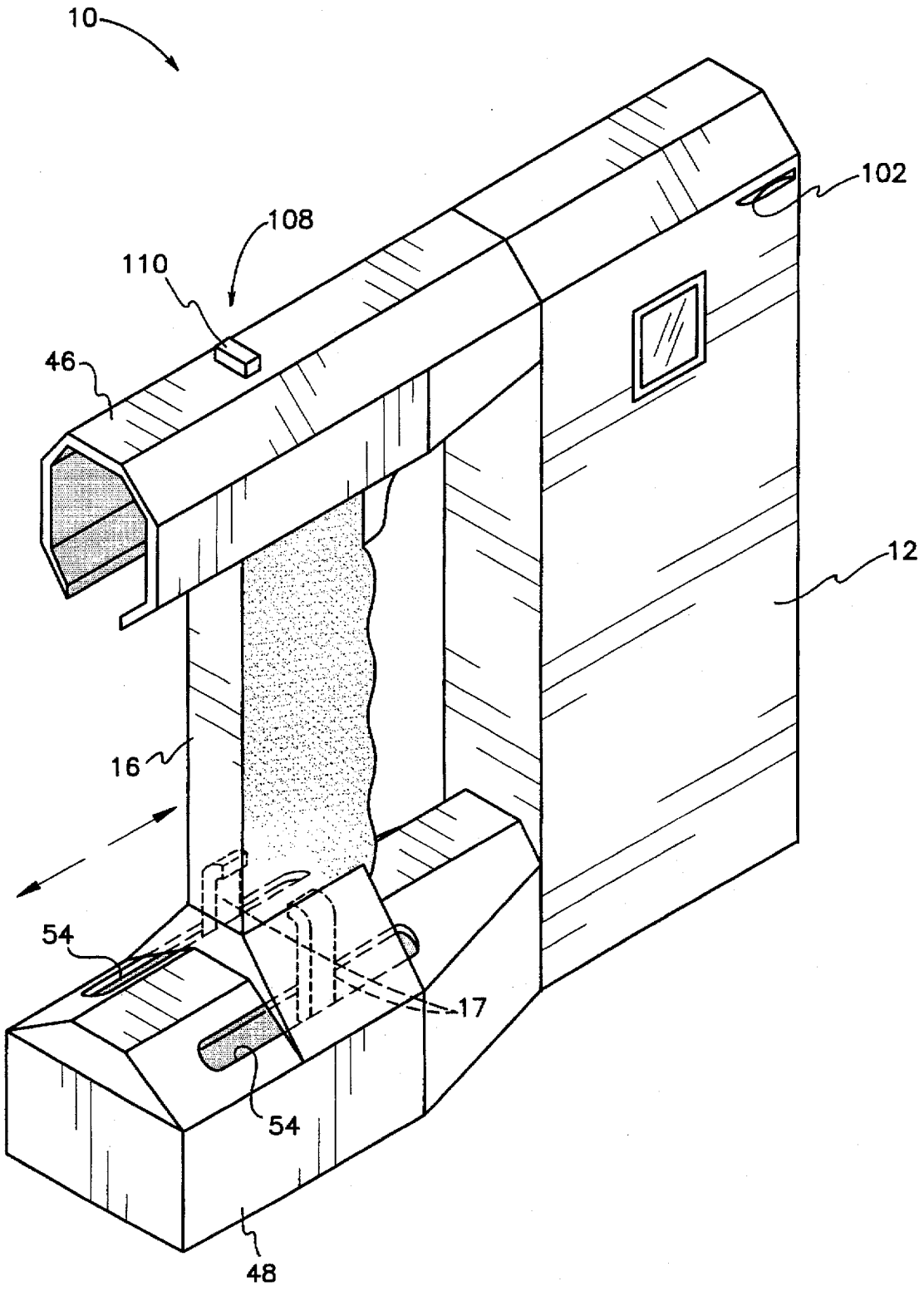
FIG. 7 is a perspective view of the invention illustrating the handle in a fully depressed condition.

Turning now to FIG. 6, the driver shaft 20 includes a lower end 24 having a square shaped bore 60 formed therein with a side slot 62 affording access into the bore 60. The tip 22 is a separate magnetic replaceable bit 64, having a square shaped shank 66 that is insertable into the bore 60. The bit 64 may be removed from the bore 60 by prying. To do this, a small bladed tool (not shown) is inserted through the slot 62. A square shaped magnet 68 is placed within the bore 60, behind the bit 64, to hold the head 34 of an engaged screw 32 against the bit 64. Of course, once driven into the work piece 40, the screw 32 will no longer be retained by magnetic attraction.

With particular reference to FIG. 4, the coupling structure 26 entraps the tapered portion 70 of the upper end 28 of the driver shaft 20 between a pair of ball bearing assemblies 72. Ball bearing assemblies 72 are carried on one end 74 of handle 16. Raising and lowering of handle 16 therefore also raises and lowers driver shaft 20, since the upper end 28 of the driver shaft 20 is entrapped between ball bearing assemblies 72.

Drive train 30 will now be discussed. Driver shaft 20 has splines 76 extending along the entire length thereof, below upper end 28. Splines 76 enable geared engagement of driver shaft 20 with a spur gear 78. Spur gear 78 is supported by suitably journaling a first shaft 82 at a fixed point within housing 12. A second or output shaft 84 extends from the motor 80. Shafts 82 and 84 are connected by a third shaft 86. Shaft 86 is suitably journaled within housing 12 proximate the hollow base 44.

A first set of intersecting bevel gears 88 rotatably connects the first shaft 82 with the second shaft 84. A second set of intersecting bevel gears 90 connects the third shaft 86 and the second shaft 84, so that rotation of the motor 80 will be transferred to the spur gear 78, to rotate the driver shaft 20. It will be appreciated that due to the length of the splines 76, driver shaft 20 will be rotated even when it is moved vertically upwardly and downwardly as handle 16 is depressed and released.

Magazine 38 comprises three plates 92 secured in position by attachment to the hollow base 44 under the first hollow arm 46. The three plates 92 are disposed on three sides of the forwardmost screw 32. The fourth side is occupied by the row of screws in storage, as will be explained further hereinafter. One plate 92 is clearly visible in FIG. 4, two surrounding plates 92 being removed for clarity in this view. These two surrounding plates 92 are seen in FIG. 3.

Plates 92 hold the forward screw 32 in an upright position for engagement by tip 22 of driver shaft 20. Plates 92 are slightly flexible, being constructed of spring steel or a similar material, so that they spread or deflect to allow passage of a screw 32 when being driven by driver shaft 20. Plates 92 return to their normal position by resilience of the constituent material.

A magazine pressure block 94 bears against the head 34 of the rearward screw 32, thereby urging the row of screws 32 towards a forward position beneath driver shaft 20.

A partially surrounding trough serving as a channel 96 is mounted longitudinally within the hollow base 44, directly under and parallel to the third shaft 86. Channel 96 comprises a major component of magazine 38, holds a supply of screws 32, and opens to an opposite side of the hollow base 44, under the second hollow arm 48. Channel 96 is V-shaped when viewed from the end, so as to cooperate with the generally conical heads 34 of screws 32. Channel 96 is open at the bottom to enable shanks 36 of screws 32 to pass therethrough. Channel 96 provides sufficient clearance to hold screws 32 in a generally vertical orientation as depicted in FIGS. 4 and 6, and loosely enough to allow screws 32 to slide towards the forward position responsive to spring pressure. An access door 98 closes channel 96, providing access to channel 96 enabling the supply of screws 32 to be renewed when depleted.

An elongated spring 100 within the channel 96 is connected at its proximal end to the magazine pressure block 94, while the distal end of the spring 100 bears against the door 98 when door 98 is closed. This arrangement assures that the magazine pressure block 94 will always bear against the head 34 of the rearward screw 32. In turn, this pressure acts to propel the entire row of screws 32 so that there is always one screw 32 in the forward position beneath driver shaft 20.

A marker line or indicia 102 on a side of the hollow base 44 indicates alignment of the forward screw 32 with respect to the work piece 42. A window 104 on the side of the hollow base 44 reveals remaining supply of screws 32 present within channel 96. A slidably removable panel 106 located on the side of the hollow base 44 directly next to the lower end 24 of the driver shaft 20 affords access to slot 62 (see FIG. 6), so that the bit 64 can be removed and replaced when needed.

The depressed position of handle 16 is shown in FIG. 7. It will be seen that handle 16 has members cooperating with arms 46 and 48 to enable travel between the positions shown in FIG. 1 and FIG. 7, and indicated by an arrow in FIG. 7. At one end 74, that being the end towards the top of FIG. 7, handle 16 is configured to cooperate with the open space or cavity defined within the walls of arm 46. At the lower end, as depicted in FIG. 7, handle 16 has fingers 17 which ride within cooperating slots 54. Handle 16 thus cooperates with housing 12 at both ends of handle 16, thereby avoiding binding as handle 16 is raised and lowered relative to the surface of the work piece 42 (see FIG. 1).

The first hollow arm 46 has a side slot 108 therein, approximately half way down from the handle 16. A slide bolt 110 mounted on the end 74 of the handle 16 can penetrate slot 108 when the handle 16 is fully depressed. This creates an interference, thereby locking handle 16 in the fully depressed position. Slide bolt 110 is clearly seen in FIG. 1 to include a projection affording engagement by the user's finger. FIG. 7 shows one end of slide bolt 110 projecting through slot 108 after handle 16 has been fully depressed.

FIG. 4 shows a reverse and forward switch 112 mounted on the end 74 of the handle 16 next to the slide bolt 110. The switch 112 is electrically connected to the motor 80 by a flexible electrical cable (not shown), so that the operator has full access to switch 112 regardless of whether handle 16 has been depressed. The switch 112 is a reversing switch for enabling the motor 80 to thread screws 32 into the work piece 40 and also to withdraw screws if desired.

LIST OF REFERENCE NUMBERS

10 automatic screw gun
12 housing
14 exit port
16 handle
17 fingers
18 guide assembly
20 driver shaft
22 tip
24 lower end of 20
26 coupling structure
28 upper end of 20
30 drive train
32 screw
34 head of 32
36 threaded shank of 32
38 magazine
40 user's hand
42 work piece
44 hollow base of 12
46 first hollow arm of 12
48 second hollow arm of 12
50 finger grip on 16
52 trigger on 16
54 track in 46, 48
56 compression spring
58 shock absorber
59 plunger
60 square shaped bore in 24
61 stem
62 side slot on 24
63 floor of cylinder of 58
64 magnetic replaceable bit for 22
65 air relief valve
66 square shaped shank on 64
67 spring of 65
68 square shaped magnet in 60
70 tapered portion of 28
72 ball bearing assemblies
74 end of 16
76 spline on 20
78 spur gear
80 electric motor
82 first shaft
84 second shaft
86 third shaft
88 first set of intersecting bevel gears
90 second set of intersecting bevel gears
92 pressure plate
94 magazine pressure block
96 channel
98 door
100 elongated spring in 96
102 marker line on 44
104 window in 44
106 panel on 44
108 side slot in 46
110 slide bolt on 74
112 reverse and forward switch It will be understood that each of the elements described above, or two or more together may also find a useful application in other types of methods differing from the type described above.

While certain novel features of this invention have been shown and described and are pointed out in the appended claims, the invention is not intended to be limited to the embodiment set forth above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An automatic screw gun comprising:

a housing having a base, a first arm and a second arm spaced apart from said first arm, said first arm and said second arm projecting upwardly from said base, said housing having an exit port located beneath said first arm;

a handle, and means for slidably mounting said handle to said first arm and to said second arm and between said first arm and said second arm;

a driver shaft, means for supporting said driver shaft in said housing above said exit port, and coupling means for coupling said drive shaft to said handle, so that said driver shaft will move in tandem with said handle;

a motor enclosed within said housing, for rotating said driver shaft, and means for rotating said driver shaft from said motor; and means for holding a row of screws within said housing and for holding one screw in a forward position beneath said driver shaft and above said exit port.

2. An automatic screw gun as recited in claim 1, wherein said handle includes a plurality of finger grips and a trigger of a switch for operating said motor.

3. An automatic screw gun as recited in claim 1, further comprising spring means urging said handle into an original position.

4. An automatic screw gun as recited in claim 3, further comprising a shock absorber connected to said handle, to slow down the return of said handle responsive to urging by said spring means.

5. An automatic screw gun as recited in claim 4, wherein said driver shaft includes:

a lower end having a square shaped bore therein; and a replaceable bit having a square shaped shank that is insertable into said bore; and a magnet located within said bore, to hold a screw against said bit by magnetic attraction.

6. An automatic screw gun as recited in claim 5, said housing further including a removable panel located on the side of said hollow base proximate said driver shaft, whereby access is provided for removing a bit from said driver shaft.

7. An automatic screw gun as recited in claim 1, said driver shaft having a tapered portion, and said coupling means comprising at least one ball bearing assembly engaging said driver shaft by contact with said tapered portion.

8. An automatic screw gun as recited in claim 1, said means for holding a row of screws within said housing and for holding one screw in a forward position beneath said driver shaft and above said exit port comprising a channel open at the bottom for holding screws, spring means urging screws contained within said channel into a forward position located beneath said driver shaft and above said exit port, and a plurality of plates for holding a screw in the forward position in place, said plates being resilient for deflecting to allow passage of the screw in the forward position.

9. An automatic screw gun as recited in claim 8, said housing further comprising a window for enabling observation of screws contained within said channel, whereby the supply of screws may be directly observed by a user without opening said housing.

10. An automatic screw gun as recited in claim 1, further including indicating means for indicating alignment of a screw in a forward position within said housing with respect to a work piece for receiving the screw.

11. An automatic screw gun as recited in claim 1, further including means for locking said handle in a fully depressed position.

12. An automatic screw gun comprising:

a housing having a base, a first arm and a second arm spaced apart from said first arm, said first arm and said second arm projecting upwardly from said base, said housing having an exit port located beneath said first arm;

a handle, means for slidably mounting said handle to said first arm and to said second arm and between said first arm and said second arm, and spring means urging said handle into an original position;

a driver shaft, means for supporting said driver shaft in said housing above said exit port, and coupling means for coupling said drive shaft to said handle, so that said driver shaft will move in tandem with said handle;

a motor enclosed within said housing, for rotating said driver shaft, and means for rotating said driver shaft from said motor;

means for holding a row of screws within said housing and for holding one screw in a forward position beneath said driver shaft and above said exit port;

a shock absorber connected to said handle, to slow down the return of said handle; and indicating means for indicating alignment of a screw in a forward position within said housing with respect to a work piece for receiving the screw.

* * * * *